United States Patent [19]

Ugolini

[11] Patent Number: 4,696,417

[45] Date of Patent: Sep. 29, 1987

[54] REFRIGERATED BEVERAGE DISPENSER, WITH WHIPPER DEVICE

[75] Inventor: Giancarlo Ugolini, Milan, Italy

[73] Assignee: Ugolini S.p.A., Milan, Italy

[21] Appl. No.: 860,047

[22] Filed: May 6, 1986

[30] Foreign Application Priority Data

Mar. 28, 1986 [IT] Italy ..... 19912 A/86

[51] Int. Cl.[4] ..... B67D 1/10; B67D 5/62

[52] U.S. Cl. ..... 222/146.6; 62/392; 137/896; 222/190; 222/318; 222/333; 222/376; 222/377; 261/36.1; 261/93; 261/DIG. 7; 261/DIG. 75

[58] Field of Search ..... 222/146.6, 190, 318, 222/333, 372, 376, 377; 261/36.1, 93, DIG. 7, DIG. 75; 366/317, 182, 194–196; 62/392; 137/896; 417/317, 502

[56] References Cited

U.S. PATENT DOCUMENTS

| | | | |
|---|---|---|---|
| 3,119,531 | 1/1964 | Jacobs | 222/318 |
| 3,385,413 | 5/1968 | Jacobs et al. | 222/318 X |
| 3,425,410 | 2/1969 | Cammack | 417/317 X |
| 4,537,332 | 8/1985 | Brown et al. | 222/376 X |

FOREIGN PATENT DOCUMENTS

| | | | |
|---|---|---|---|
| 531995 | 10/1956 | Canada | 222/146.6 |
| 637179 | 2/1962 | Canada | 222/146.6 |

*Primary Examiner*—Joseph J. Rolla
*Assistant Examiner*—Kevin P. Shaver
*Attorney, Agent, or Firm*—Diller, Ramik & Wight

[57] ABSTRACT

A refrigerated beverage dispenser having a base supporting a container housing a device for circulating and whipping a beverage. An evaporator is located in the container while the refrigerator unit thereof is housed within the base, along with a motor and a magnetic transmission for driving a circulating and whipper device within the container. The impeller is rotatably mounted upon a pin in a housing chamber of the container and includes a plurality of ports associated with pipes for both circulating the beverage within the container and dispensing the beverage outside of the container. One of the pipes is connected to a port of the impeller housing and has a non-return valve which selectively regulates fluid communication between the container and the housing chamber. Another pipe connects the impeller housing to the container exterior for dispensing the beverage. A float is carried by the pivot which has a plurality of holes for controlling beverage flow as the motor, which is preferably a single two-speed electrical motor, is controlled by a switch actuated exteriorly of the container.

10 Claims, 5 Drawing Figures

REFRIGERATED BEVERAGE DISPENSER, WITH WHIPPER DEVICE

The object of the present invention is a refrigerated beverage dispenser, having whipper device.

Refrigerated dispensers for beverages provided with whipper devices are known, e.g., from U.S. Pat. No. 3,920,163, which discloses a dispenser for drinks provided, in a container, with a beverage circulating device, and with a whipper device which can be identified as a separate and distinct unit from the circulating device.

In the dispenser for beverages as mentioned, two separate motors are provided, one to circulate the drink inside the container and another one, controlled by a switch linked to the lever controlling the beverage dispensing, driving the whipper device every time the dispensing lever is actuated to obtain a dose of beverage.

The dispenser mentioned, in particular having a plurality of containers, involves a considerable complexity for the viewpoint of the electrical connections, because at least two motors are provided per each container, with a consequent increase of the overall costs, as regards the purchase and time required to assemble such a number of components.

It must be moreover considered that the more numerous are the component parts, the greater are the probabilities of failures and of corresponding repairs.

A purpose of the present invention is to obviate the drawbacks of the mentioned prior art by providing a refrigerated beverage dispenser having one or more containers, each provided with a whipper device associated with a circulation/refrigerating system, simplified in its inner structure, and at the same time achieving simplification of functions with reduced financial costs.

In view of the foregoing, there is provided a refrigerated beverage dispenser, with whipper device comprising:

(a) a base carrying on its upper part at least one container, (b) a device for circulating and whipping a beverage within the container, and communicating with the outside of the container, (c) motor means operatively linked by a magnetic transmission to the circulating and whipper device, housed inside the base, (d) a refrigerator unit housed inside the basis, and (e) an evaporator of the refrigerator unit is sealingly housed within the container.

the circulating and whipper device comprises:

(a) an impeller magnetically driven by the motor means, (b) a housing chamber provided with ports and openings in communication with the container and with the outside of the container, inside which the impeller is housed, (c) a pivot housed inside the housing chamber, provided with holes on its upper part and on its lower part, around which the impeller rotates, (d) a first pipe having a non-return valve installed in a peripheral portion of the housing chamber, (e) a bell provided in the lower part of the pivot, (f) a second pipe inside which the pivot ends having its upper end above the free surface of the beverage in the container, (g) a float mounted coaxially to said pivot and to the portion of the housing chamber inside which the pivot is housed, and the magnetic transmission and motor means are, for each container, one single two-speed electrical motor controlled by a switch actuated from the outside of the container.

The present invention shall be now disclosed with reference to the figures of the attached drawings, wherein.

Figure 1:
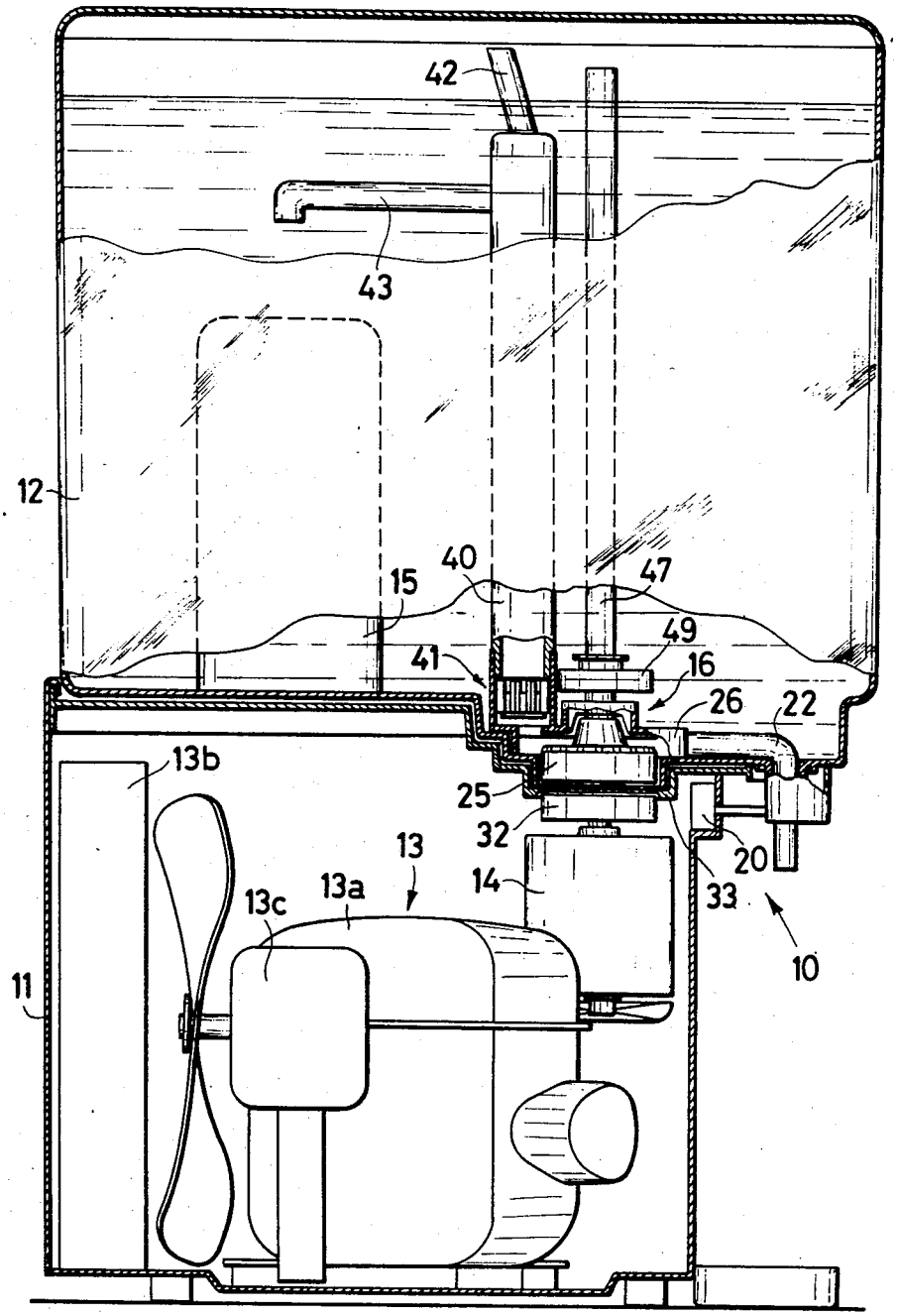
FIG. 1 is a partly sectional elevation view of the beverage dispenser according to the present invention.

Referring to the figures, a beverage dispenser 10 according to the invention is constituted by a base 11 and by a container 12.

Inside the base 11 are housed a refrigerator unit 13, constituted by a compressor 13*a*, a condenser 13*b*, a fan 13*c*, and a two-speed magnetic-transmission motor 14. The refrigerator unit 13 is completed by an evaporator 15 contained inside the container 12 (the sealed pipings connecting the different components of the refrigerator unit 13 with each other are accomplished in a known way, and they are hence not shown in the figures), while the two-speed magnetic transmission motor 14 alternatively causes a beverage contained in the container 12 to circulate, and provides for it to be distributed by means of a circulation/whipper-distributing device 16 inside the container 12.

The circulation/whipper-distribution device 16 is controlled by a switch 20, which can be actuated manually or through suitable electromechanical connections (accomplished in a known way, and hence not shown) by a distribution cock 21.

The switch 20, connected to the two-speed motor 14, carries out the switchover of the two speeds thereof, in such a way that the device 16 is alternatively present so as to allow the beverage to be circulated inside the container 12, or so as to allow said whipped beverage to be distributed through a pipe 22 constituting the outlet means from the container 12.

The circulating/whipper-distribution device 16 housed inside the container 12 is substantially constituted by an impeller 25 and by a housing chamber 26.

The impeller 25, rotatably housed inside the chamber 26 by means of a pivot 27, is provided on its upper surface with a radial toothing 28 having oblique end portions 28*a* and with cantilevering radial elements 29 extending between each of the contiguous oblique end portions 28*a*, from the periphery towards the center of the impeller 25. Furthermore, the side surface 30 of the impeller 25 is smooth, and inside said impeller 25, a first magnet 31 is embedded, which is positioned in correspondence of a second magnet 32 provided on the two-speed motor 14. Between the first magnet 31 and the second magnet 32 a separation wall 33 is provided, belonging to a drop-collecting plate which separates the container 12, containing the beverage, from the base 11. The transmission of the motion between the two magnets being accomplished in a known way.

The housing chamber 26 has an inner side wall 34 with a portion 34*a* having a profile of essentially spiral shape, a portion 34*b* having a concentric profile, and a top wall 35 provided with three radial openings 36 with their axes being spaced 120° from each other, and centrally provided with a hole 37 for the passage of the pivot 27. The chamber 26 is furthermore provided with a first outlet port 38, placed tangentially to the portion 34*b* of the side wall 34, and connected to the container outlet pipe 22, and is furthermore provided, in correspondence of a peripheral zone thereof, with a second port 39 destined to house a first pipe 40 interiorly equipped with a non-return valve device 41. The non-return valve device 41, constituted by a cylindrical element 55, having in its bottom portion a sealing membrane element 56 and a set of radial grooves 57, is slidingly housed inside the pipe 40, between an upper shoulder 58 and a lower shoulder 59.

Furthermore, the pipe 40 is provided with an upper portion 42 emerging from the free surface of the beverage contained in the container 12, and with a further L-shaped horizontal pipe 43 adjacent to the top of the evaporator 15 contained inside the container 12.

The pivot 27, around which the impeller 25 rotates, is constituted by a hollow body provided in its central portion with holes 44, in its lower portion with holes 45, and in its upper portion with seal rings 46, on which a second pipe 47, with its upper end emerging from the free surface of the beverage inside the container 12 and provided in its bottom portion with a circular shoulder 48, is mounted. A bell 70 is provided in the lower portion of said pivot 27 adjacent the holes 45.

Coaxially with the pivot 27 and with the portion of the chamber 26 inside which it is housed, a float 49 is provided, which can be, e.g., of annular or eccentric type, and which can vary its position between the shoulder 48 provided on the second pipe 47 and an opposite shoulder 50.

The holes 44 extend into the portion of chamber 26 within which the pivot 27 is housed. The float 49 is moreover slidingly mounted with such a clearance as to leave a gap 51 through which the beverage can flow, depending upon the operative condition of the beverage dispenser according to the present invention.

Figure 2:
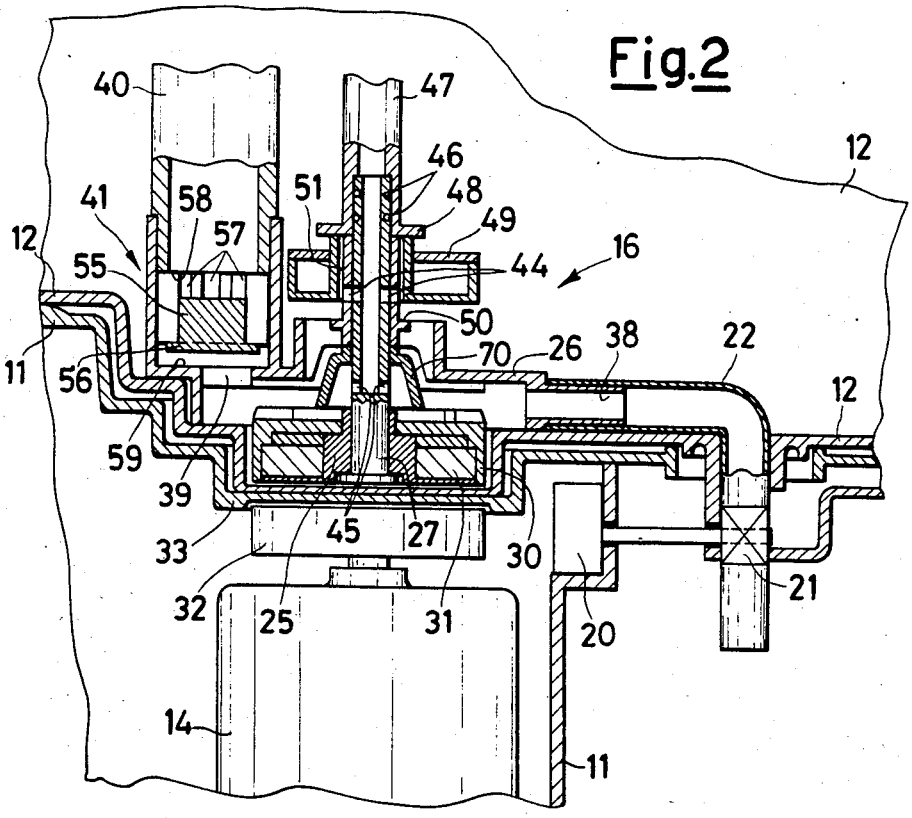
FIG. 2 is a sectional view of an enlarged detail of FIG. 1.
Figure 4:
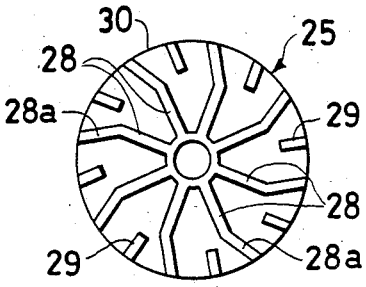
FIG. 4 is a top plan view of an impeller inside the container of the distributor.
Figure 5:
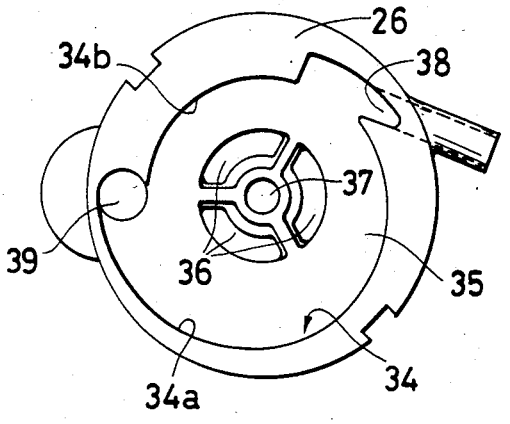
FIG. 5 is a bottom plan view of the impeller housing of FIG. 4.

During the operating of the dispenser according to the invention, without distribution of whipped beverage, the motor 14 runs at the lower turning speed provided for it, causing the beverage to circulate inside the container 12 (FIG. 2). Under this condition, the float 49 is in contact with the shoulder 48, allowing the beverage inside the container 12 to be drawn in by the impeller 25 through the openings 36. At this point the beverage drawn in by the impeller 25 (having no escape to the outside because the cock 21 is closed) flows toward the non-return valve device 41. Here, because of the pressure generated inside the chamber 26 by the impeller 25 prevailingly adjacent the portion 34*a*, the beverage raises the sealing membrane element 56, bringing the cylindrical element 55 affixed to it into contact with the upper shoulder 58, and flows through a passage 39 and the radial grooves 57 up to the pipes 40, 42 and 43.

This type of circulation allows the beverage to be cooled by means of its flowing through the pipe 43, which is positioned adjacent the evaporator 15, and at the same time allows such a circulation as not to allow possible deposits to settle inside the container 12.

Figure 3:
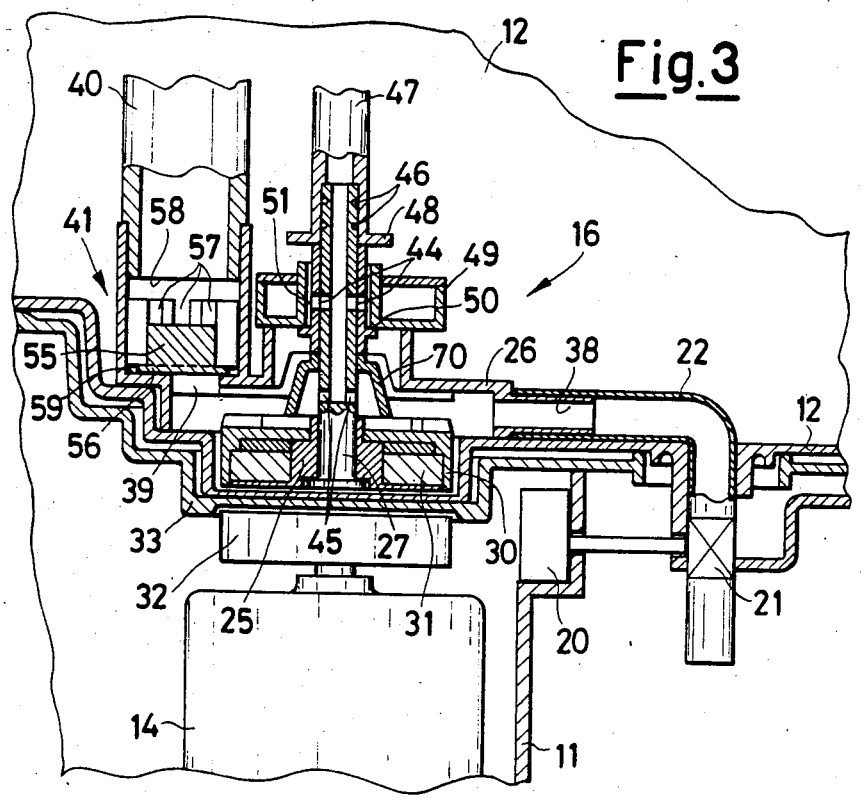
FIG. 3 is a view of the elements of FIG. 2 in a different operative position.

In order to distribute the beverage from inside to outside the container 12 (FIG. 3), an operator must open the distribution cock 21, thus actuating the switch 20 (electrically connected to the motor 14 in a known way and hence not shown), which causes the turning speed of the motor 14 to be switched over to the higher value.

Due to the effect of the pressure drop caused as a consequence of the sudden flow rate increase in the central portion of the chamber 26, in correspondence of the openings 36, the float 49 is pulled downwards to the shoulder 50, so as to close the openings 36 provided in the upper wall 35 of the chamber 26 (FIG. 3), and to keep open the gap 51 only.

Under this condition, the beverage finds a preferential outlet way towards the outside through the pipe 22, while the non-return valve device 41, because of the lack of a thrust upwards, shall close the passage 39, also assisted by the pressure of the liquid column existing inside the pipe 40.

As a consequence of the foregoing, the beverage which is stored inside the container 12 is taken in through the gap 51, the holes 44 and 45 of the hollow pivot 27, inside the chamber 26 together with the air taken in through the pipe 47, the hollow pivot 27 and the holes 45, and both the air and liquid are evenly diffused by the bell 70.

Inside the chamber 26, due to the effect of the particular shaping of the impeller and of the chamber, the beverage shall be vigorously whipped with consequent dispersion of air with beverage, thereby resulting in a liquid having a foamy characteristic.

When the operator wishes to interrupt the distribution he must close the cock 21: by so doing, the switch 20 acts on the motor 14, which suddenly decreases it turning rate, the pressure drop condition in the central portion of the chamber 26 is practically reduced to zero. The hydrostatic thrust on the float 49 becoming thus prevalent, and the float 49 returns to rest against the shoulder 48.

In this way, the beverage present inside the container 12 restarts entering the chamber 26 through the openings 36, restoring the normal circulation/refrigerating cycle.

It should be observed how the beverage dispenser 10 according to the present invention embodies one single motor, per each container provided, a device for circulating the beverage inside the container and for the whipping and distribution of the same to the outside.

The present invention has been disclosed according to a preferred embodiment thereof referring to the attached drawings, but it is to be intended that modifications and alterations can be made by those skilled in the art without departing from the scope covered by the present patent.

What is claimed is:

1. Refrigerated beverage dispenser and whipper device comprising:

a base having on an upper part at least one container, a device for circulating and whipping a beverage housed within said at least one container, and communicating with the outside of the container, motor means operatively linked by a magnetic transmission means to said circulating and whipper device and housed inside said base, a refrigerator unit housed inside said base, an evaporator of said refrigerator unit sealingly housed within said at least one container, said circulating and whipper device includes:

an impeller magnetically driven by said motor means, a housing chamber having ports in communication with said at least one container and with the outside of said container, within which the said impeller is housed, a pivot means housed inside said housing chamber and provided with a hollow interior in communication with holes on its upper part and on its lower part around which said impeller rotates, a first pipe having a non-return valve in a peripheral portion of said housing chamber, said first pipe being connected to a first of said ports in fluid communication between said container and said housing, a bell-shaped structure provided in the lower part of said pivot means said pivot means projecting through a second of said ports, a second pipe inside which said pivot means ends, and having an upper end above the surface of a beverage within said container, a float mounted coaxially to said pivot means, and to a portion of said chamber inside of which said pivot means is housed, and said motor means is a single two-speed electrical motor controllable by a switch actuated from the outside of said container.

2. Refrigerated beverage dispenser according to claim 1, wherein said housing chamber has a smooth inner side wall provided with a portion having a spiral shape, a concentric portion, and an upper wall having at least three openings radially positioned relative to the pivot means.

3. Refrigerated beverage dispenser according to claim 1, wherein said housing chamber is furthermore characterized by an inner side wall which has a third of said ports positioned tangentially to a concentric portion of said inner side wall.

4. Refrigerated beverage dispenser according to claim 1, characterized in that said non-return valve is slidingly movable between a lower shoulder and an upper shoulder inside said first pipe.

5. Refrigerated beverage dispenser according to claim 1, characterized in that said first pipe has an upper portion emerging from the surface of the beverage within the container and is connected to a further pipe having an L-shape which is horizontally positioned above said evaporator.

6. Refrigerated beverage dispenser according to claim 1, characterized in that said impeller has a smooth side surface.

7. Refrigerated beverage dispenser according to claim 1, characterized in that said second pipe is connected to said pivot means.

8. Refrigerated beverage dispenser according to claim 1, characterized in that said float is movable coaxially relatively to said pivot means and to the portion of said housing chamber inside which said pivot means is housed between an annular shoulder provided on said second pipe and a shoulder provided on said housing chamber adjacent to said second of said ports located on an upper wall of said housing chamber.

9. Refrigerated beverage dispenser according to claim 1, characterized in that said impeller has on its upper surface, radially disposed teeth and radial elements, said teeth having end portions thereon which are oblique to the teeth, said radial elements being located between said teeth and extending from an outer edge of the impeller towards its center.

10. Refrigerated beverage dispenser according to claim 9, characterized in that said bell-shaped structure provided in the lower portion of said pivot means surrounds and is spaced from said holes in the lower part of said pivot means, and a lower portion of said bell-shaped structure being disposed above the teeth on said impeller.

* * * * *